US009670892B2

(12) United States Patent
Abe et al.

(10) Patent No.: US 9,670,892 B2
(45) Date of Patent: Jun. 6, 2017

(54) ENGINE STARTUP DEVICE

(75) Inventors: Masami Abe, Chiyoda-ku (JP); Koichiro Kamei, Chiyoda-ku (JP); Kazuhiro Odahara, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 253 days.

(21) Appl. No.: 14/378,713

(22) PCT Filed: May 17, 2012

(86) PCT No.: PCT/JP2012/062626

§ 371 (c)(1),
(2), (4) Date: Aug. 14, 2014

(87) PCT Pub. No.: WO2013/171876

PCT Pub. Date: Nov. 21, 2013

(65) Prior Publication Data

US 2015/0020761 A1 Jan. 22, 2015

(51) Int. Cl.

| | |
|---|---|
| ***F02N 11/08*** | (2006.01) |
| *F02N 11/00* | (2006.01) |
| *F02N 15/06* | (2006.01) |
| *H01H 51/06* | (2006.01) |
| *F02N 15/02* | (2006.01) |
| *F02N 15/04* | (2006.01) |

(52) U.S. Cl.

CPC ..... *F02N 11/087* (2013.01); *F02N 15/062* (2013.01); *F02N 11/00* (2013.01); *F02N 15/022* (2013.01); *F02N 15/046* (2013.01); *F02N 15/067* (2013.01); *F02N 2011/0874* (2013.01); *F02N 2015/061* (2013.01); *H01H 51/065* (2013.01)

(58) Field of Classification Search

CPC .... F02N 15/067; F02N 11/087; F02N 15/023; F02N 11/00; F02N 15/022; F02N 15/04; F02N 15/062; F02N 11/02; F02N 2011/0874; F02N 15/02; F02N 15/066

USPC ..... 123/179.1, 179.28, 179.25; 74/6, 74/7 A–7 E, 7 R, 8

See application file for complete search history.

(56) References Cited

U.S. PATENT DOCUMENTS 3,140,617 A * 7/1964 Palmer ..... F02N 15/023 74/6
4,395,923 A * 8/1983 Giometti ..... F02N 15/065 192/114 R (Continued)

FOREIGN PATENT DOCUMENTS

JP 59-147120 A 8/1984
JP 05-212666 A 8/1993

(Continued)

OTHER PUBLICATIONS

International Search Report for PCT/JP2012/062626 dated Jun. 26, 2012.

*Primary Examiner* — Long T Tran
(74) *Attorney, Agent, or Firm* — Sughrue Mion, PLLC; Richard C Turner

(57) ABSTRACT

An engine startup device is provided having a helical-spline-engaging part where an output shaft (5) and a moving body (3) are coupled with each other, wherein a notch (37*b*, 38*b*) is formed on a power-transmitting-side tooth surface (37*a*, 38*a*) of at least either one of the output shaft and the moving body, and an angle formed by the notch with respect to a shaft direction is made smaller than the lead angle of a helical spline.

5 Claims, 6 Drawing Sheets

(56) References Cited

U.S. PATENT DOCUMENTS 4,524,629 A * 6/1985 Digby ..... F02N 15/065 74/7 R
4,552,258 A 11/1985 Sigg et al.
4,737,654 A * 4/1988 Morishita ..... F02N 15/06 290/48
5,265,485 A * 11/1993 Sakamoto ..... F02N 15/043 290/38 C
5,525,947 A * 6/1996 Shiga ..... F02N 11/0851 335/126
5,684,334 A * 11/1997 Zenmei ..... F02N 15/06 290/38 R
5,945,755 A * 8/1999 Ohmi ..... F02N 11/00 290/38 C
6,298,751 B1 10/2001 Ide et al.
7,101,299 B2 * 9/2006 Murata ..... F02N 15/023 475/149
7,302,869 B2 * 12/2007 Kamei ..... F02N 15/023 74/6
2003/0169069 A1 * 9/2003 Fifield ..... H03K 19/0005 326/30
2005/0115339 A1 6/2005 Aoki et al.
2006/0169069 A1 * 8/2006 Kamei ..... F02N 15/023 74/6
2009/0183595 A1 7/2009 Niimi
2010/0050970 A1 3/2010 Okumoto et al.
2010/0326389 A1 12/2010 Okumoto et al.
2012/0035837 A1 2/2012 Okumoto et al.
2013/0025407 A1 1/2013 Niimi

FOREIGN PATENT DOCUMENTS

JP 10-180843 A 7/1998
JP 2005-133643 A 5/2005
JP 2009-191843 A 8/2009
JP 2010-236533 A 10/2010

* cited by examiner

ENGINE STARTUP DEVICE

TECHNICAL FIELD

The present invention relates to an engine startup device that transmits motor torque from a moving body to a ring gear of an engine so as to start up the engine.

BACKGROUND ART

To date, there has been proposed an engine startup device equipped with an electromagnetic switch that can independently perform functions of turning on/off a motor activation circuit and making a moving body jump out. (See Patent document 1, for example.)

In addition, there has been another device that, using the electromagnetic switch described in Patent document 1, synchronizes rotation speed of a moving body with that of a ring gear and following that, makes the moving body jump out so as to engage with the ring gear. (See Patent document 2, for example.)

PRIOR ART DOCUMENT

Patent Document

Patent document 1: Japanese Laid-open Patent Publication No. 2009-191843

Patent document 2: Japanese Laid-open Patent Publication No. 2010-236533

DISCLOSURE OF THE INVENTION

Problem to be Solved by the Invention

In the startup device of Patent document 2, when rotation speed of the moving body is synchronized with that of the ring gear, the motor is started rotating before the moving body is made to jump out; however, there is a danger at this moment that the moving body jumps out by helical splines of the moving body and the output shaft before the rotation speed of the moving body is synchronized with that of the ring gear.

Moreover, in a startup device equipped with an electromagnetic switch capable of independently performing functions of turning on/off a motor activation circuit and making a moving body jump out, when restart is requested during inertial rotation of an engine immediately after idling stop, the motor activation circuit, in order to enable engagement during high speed rotation, is sometimes operated before operation of thrusting out the moving body. If motor torque is transmitted from the output shaft to the moving body via the helical spline engagement at this moment, force due to the motor rotation is generated in a shaft direction attributed to the lead angle, which is the inclination of the gear helical spline, and the inertia of the moving body, which would therefore pose a danger of the moving body jumping out to touch the ring gear.

FIG. 3 is a diagram for explaining a problem with a conventional engine startup device equipped with such an electromagnetic switch as described above, which can independently perform the functions of turning on/off the motor activation circuit and making the moving body jump out; FIG. 3(*a*) shows when the motor stopping and and FIG. 3(*b*), when the motor rotating.

When the motor starts rotating before the moving body jumps out, the output shaft rotates by rotation energy from the motor. The rotation energy from the output shaft is transmitted to the moving body with helical splines 37 and 38 of the output shaft and the moving body engaging with each other; when the output shaft rotates in the direction indicated by the arrow X, the moving body jumps out in the axial direction (direction indicated by the arrow Y), by the inclination of the helical spline engagement and the inertia of the moving body. Additionally, when the diagram in FIG. 3 is turned clockwise by 90°, it comes in the same direction as FIG. 1 and FIG. 2 described later; the ring gear is located in FIG. 3(*b*) in the upward direction (direction indicated by the arrow Y). Furthermore, the helical-spline-engaging part, which is originally circular, is illustrated by a plan view, showing how gears engage with each other.

In order to suppress the jump out of the moving body, a plunger spring that urges a moving-body-operating plunger is increased in load, whereby the moving body is pressed via a thrust-out mechanism in the opposite direction of the ring gear, so that the moving body can be prevented from jumping out; however, attraction force of the moving-body-operating plunger needs to be increased in this case, causing a problem in that the electromagnetic switch will increase in size.

The present invention has been made to solve such a problem as described above, and aims at providing an engine startup device that can prevent the moving body from jumping out by the motor torque and the lead angle at the helical-spline-engaging part of the output shaft and moving body, without increasing the size of the electromagnetic switch, even if the motor activation circuit is turned on before the moving body thrust-out function is performed.

Means for Solving the Problem

An engine startup device according to the present invention comprises: a motor that produces torque with electric power supplied thereto; an output shaft on which is formed a helical spline that transmits the torque from the motor; a moving body that has a helical spline engaging with the output shaft and transmits the torque from the motor to an engine; and an electromagnetic switch equipped with a mechanism that independently performs a function of magnetizing a motor-operating plunger by activating a motor-operating solenoid coil and switching on/off the power to the motor by the movement of the motor-operating plunger, and a function of magnetizing a moving-body-operating plunger by activating a moving-body-operating solenoid coil and thrusting out the moving body toward a ring gear side via a thrust-out mechanism by the movement of the moving-body-operating plunger; wherein a notch is formed on a power-transmitting-side tooth surface of a helical spline of at least either one of the output shaft and the moving body, and helical splines of the output shaft and the moving body are arranged in such a way that the notch of either one of the output shaft and the moving body engages with part of the helical spline of the other when the engine startup device stopping.

Moreover, the angle formed by the notch with respect to the motor axis direction is made smaller than the lead angle of the helical spline.

Advantage of the Invention

According to an engine startup device of the present invention, the moving body will not jump out even if the motor activation circuit is operated before the function of thrusting out the moving body is performed; therefore, the durability of the moving body and the ring gear can be enhanced, and at the same time, noise due to their collision can be eliminated, so that effects on silence can be expected. Furthermore, structural modification to the existing gear profile is small and the appearance of the engine startup device remains unchanged, so that an engine startup device excelling in layout flexibility can be provided.

The foregoing and other object, features, aspects and advantages of the present invention will become more apparent from the following detailed description of the present invention when taken in conjunction with the accompanying drawings

BEST MODE FOR CARRYING OUT THE INVENTION

Figure 1:
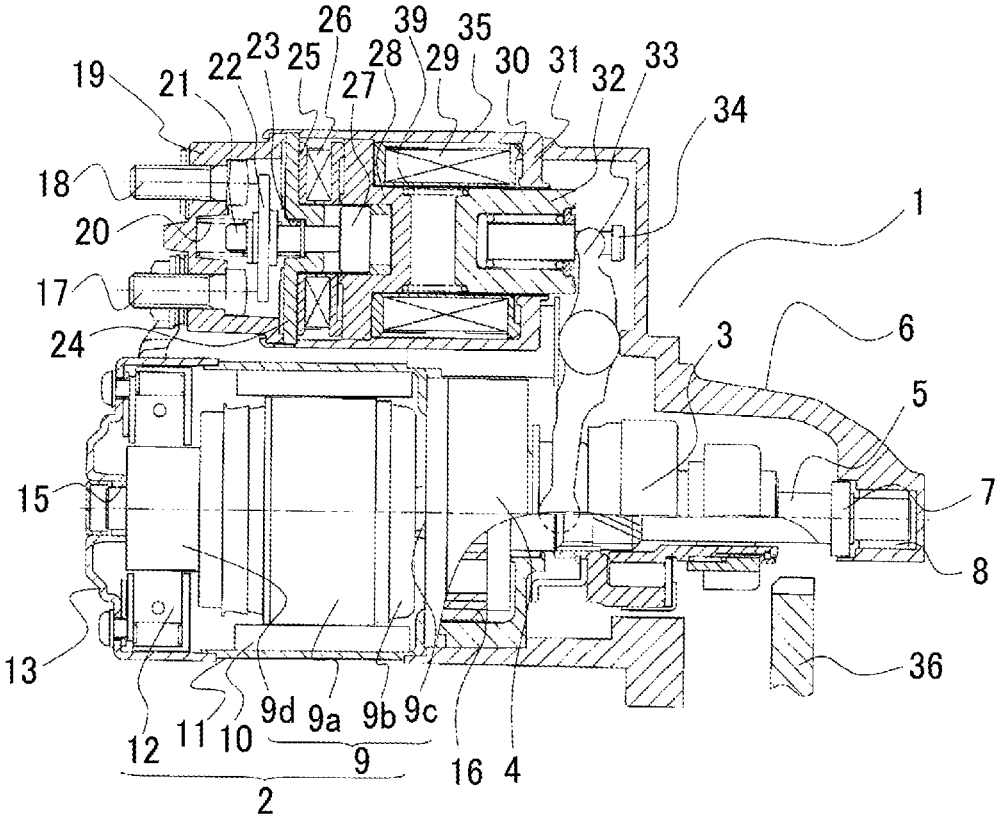
FIG. 1 is a schematic configuration diagram of an engine startup device according to Embodiment 1 to Embodiment 3 of the present invention.

Hereinafter, the embodiments of the present invention will be explained referring to FIG. 1 to FIG. 12. Additionally, the same reference numerals represent the same or corresponding parts in each drawing.

Embodiment 1

FIG. 1 is a schematic configuration diagram of an engine startup device according to Embodiment 1 of the present invention.

In FIG. 1, the engine startup device 1 includes a motor 2 that produces torque with electric power supplied to it; a moving body 3 that is helical-spline-engaged with an output shaft 5 for transmitting the torque from the motor 2 and engages with a ring gear 36, thereby transmitting the torque from the motor 2 to the engine; and a stopper 7 that restricts jump out of the moving body 3 toward the ring gear 36.

The motor 2 includes an armature 9, which serves as a rotor; a yoke 11 having a permanent magnet 10 along the inner circumference thereof; and a brush 12. The armature 9 includes a core 9*a*, an armature coil 9*b*, a motor shaft 9*c* and a commutator 9*d*; with a current flowing through the armature coil 9*b*, magnetic flux generated by the current and the core 9*a* interacts with the permanent magnet 10 to produce the torque. The motor is a well-known DC motor in which rotation is maintained in one direction by the commutator 9*d* and the brush 12.

The motor shaft 9*c* is rotatably supported by a bearing 15 that is press-inserted in a cover 13 fitted in the yoke 11 and by the output shaft 5; a deceleration mechanism is configured with a gear provided on the motor shaft 9*c* (not shown), a planet gear 16 and an annulus gear 4 of an internal gear engaging with each other.

An electromagnetic switch 35 includes a thrust-out mechanism for the moving body and a motor activation circuit.

The thrust-out mechanism for the moving body magnetizes a moving-body-operating plunger 32 by activating a moving-body-operating solenoid coil 29 housed in a moving-body-operating bobbin 30. The thrust-out mechanism is configured such that the magnetized moving-body-operating plunger 32 is attracted toward a moving-body-operating core switch 28, with a plunger spring 39 being warped, whereby a hook 34 attached to the moving-body-operating plunger 32 thrusts out the moving body 3 toward the ring gear 36 side via the thrust-out mechanism 33.

The motor activation circuit activates a motor-operating solenoid coil 26 housed in a motor-operating bobbin 25, and thereby magnetizes a motor-operating plunger 27. The magnetized motor-operating plunger 27 is attracted toward a motor-operating core switch 24, thereby pressing a rod 21 attached with a moving contact 22; a fixed B-contact 18 to which voltage is always applied from a battery, a fixed M-contact 17 connected to the motor and the moving contact 22 are contacted with each other, and a current from the battery thereby flows through the motor 2, so that the motor 2 will rotate. A point spring 23 that urges the moving contact 22 toward the fixed B-contact 18 and the fixed M-contact 17 (hereinafter each simply referred to as a fixed contact) is inserted between the rod 21 and moving contact 22, thereby securing pressing force so that the moving contact 22 is not separated from the fixed contacts 17 and 18. When a current flowing through the motor-operating solenoid coil 26 is interrupted, the rod 21 is pushed back by a return spring 20, and the moving contact 22 is separated from the fixed contacts 17 and 18, whereby the motor 2 stops rotating.

This thrust-out mechanism for the moving body and the motor activation circuit are housed in a casing 31, and a cap switch 19 attached with the fixed contacts is caulked with the casing 31 so that the contact portion is protected from fine particles and the like outside. The foregoing motor 2 and electromagnetic switch 35 are fit into a receiving/fixing portion in the engine side and the front bracket 6 that serves as a ground circuit for the engine startup device. Moreover, the bearing 8 press-inserted in the front bracket 6 rotatably supports the output shaft.

A helical-spline-engaging mechanism of the engine startup device according to Embodiment 1 will be explained next referring to FIG. 2 to FIG. 7.

Figure 2:
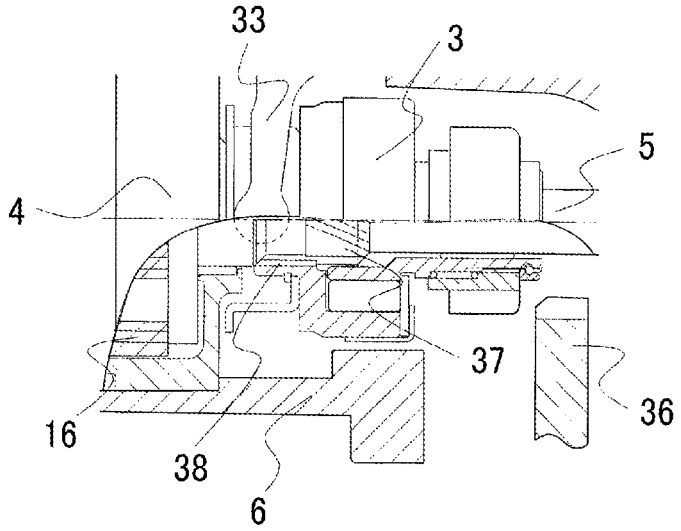
FIG. 2 is a schematic diagram of a helical-spline-engaging mechanism according to Embodiment 1 to Embodiment 3 of the present invention.
Figure 4:
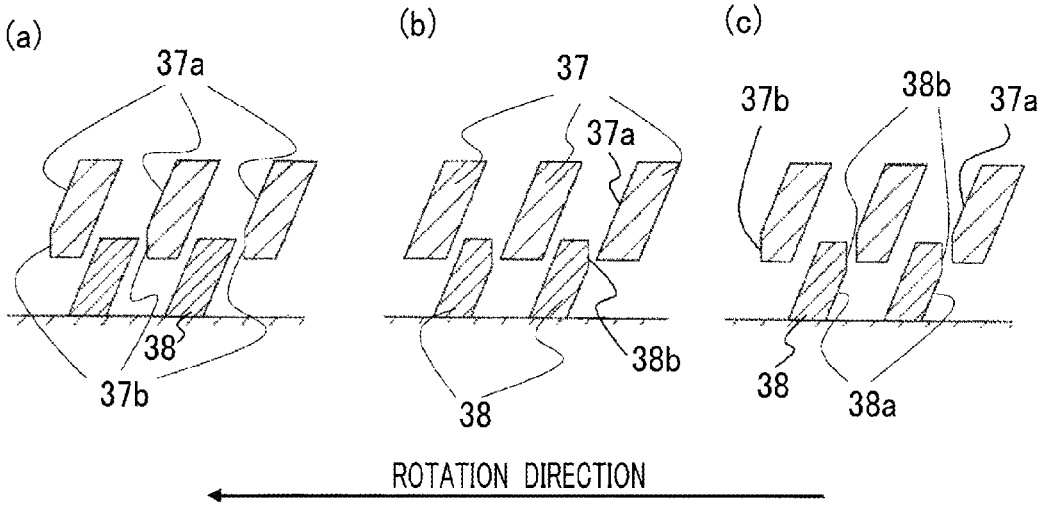
FIG. 4 is a diagram of arrangement of helical splines of an output shaft and the moving body in Embodiment 1 and Embodiment 2 of the present invention.
Figure 5:
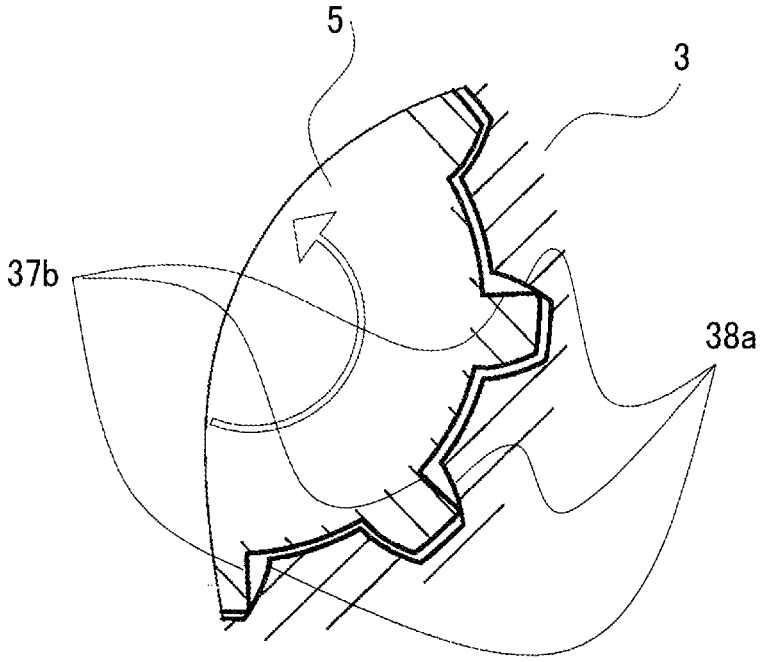
FIG. 5 is a cross-sectional diagram showing notches of the output shaft and power-transmitting-side tooth surfaces of the moving body engaging with each other in Embodiment 1 of the present invention.

As shown in FIG. 2 and FIG. 4(*a*), in the helical-spline-engaging part where the output shaft 5 and the moving body 3 are coupled with each other, a notch 37*b* is formed at the rear end of a power-transmitting-side tooth surface 37*a* on the side where the torque from the helical spline 37 of the output shaft 5 is transmitted.

The power-transmitting-side tooth surface 37*a* is a surface on which the helical spline of the output shaft engages with a helical spline 38 of the moving body 3 when the moving body 3 is engaged with the ring gear 36 by the thrust-out mechanism 33 so as to transmit the torque from the motor 2 to the engine; however, the notch 37*b* newly provided in Embodiment 1 is a surface on which the helical spline 38 of the moving body 3 touches part of the helical spline 37 of the output shaft 5 when the motor-operating solenoid coil 26 of the electromagnetic switch 35 is activated earlier than the moving-body-operating solenoid coil 29 and the motor 2 thereby starts rotating before the moving body 3 jumps out. (See FIG. 5.)

Figure 6:
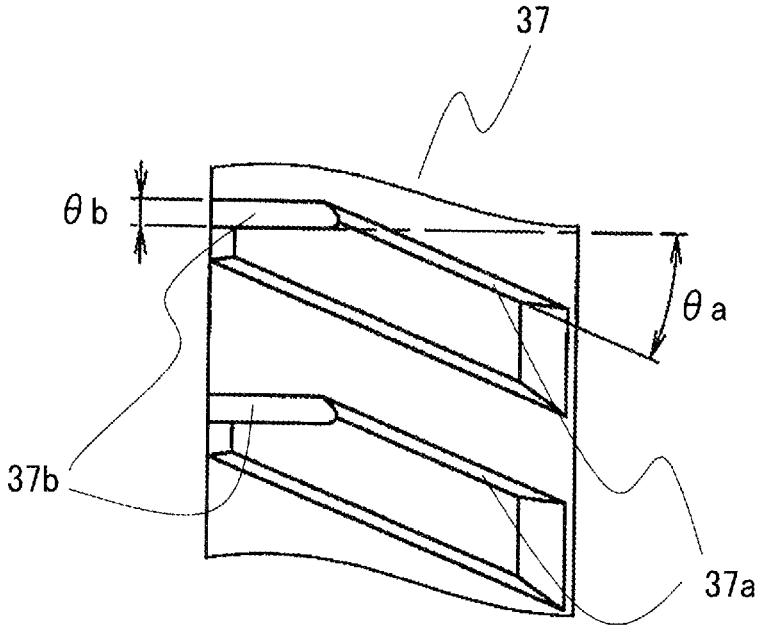
FIG. 6 is a detailed diagram showing the lead angles of the notches of the output shaft and the power-transmitting-side tooth surfaces thereof in Embodiment 1 of the present invention.

As shown in FIG. 6, the lead angle θb of the notch 37*b* of the output shaft 5 is set, with respect to the shaft direction, smaller than the lead angle θa of the power-transmitting-side tooth surface 37*a* (θa>θb); the notch 37*b* of the output shaft 5 is designed such that the moving body 3 does not collide with the ring gear 36, even if the moving body 3 jumps out by the torque from the motor 2 and the inertia of the moving body 3, when the motor-operating solenoid coil 26 of the electromagnetic switch 35 is activated earlier than the moving-body-operating solenoid coil 29.

Figure 3:
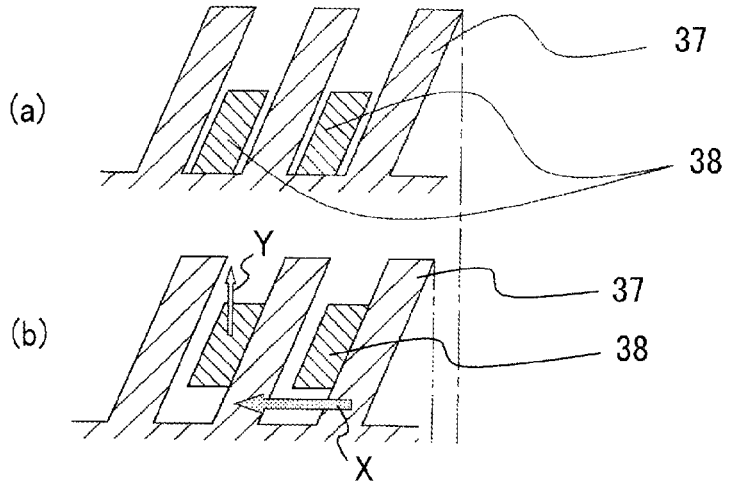
FIG. 3 is a detailed diagram for explaining a problem of a moving body jumping out at startup of motor rotation in a conventional device, which forms the background of this invention.

That is to say, if the notch 37*b* of the output shaft 5 is set parallel to the axial direction, force in the axial direction does not act, so that the moving body will not jump out only by the torque from the motor as the case with FIG. 3 described above.

Jump-out distance of the moving body 3 at startup of the motor rotation can be estimated as follows:

Let the mass of the moving body 3 be m, the inertia, I, the angular frequency of the motor 2, ω, its angular acceleration, β, the radius of the helical spline pitch circle, r, and time, t.

Figure 12:
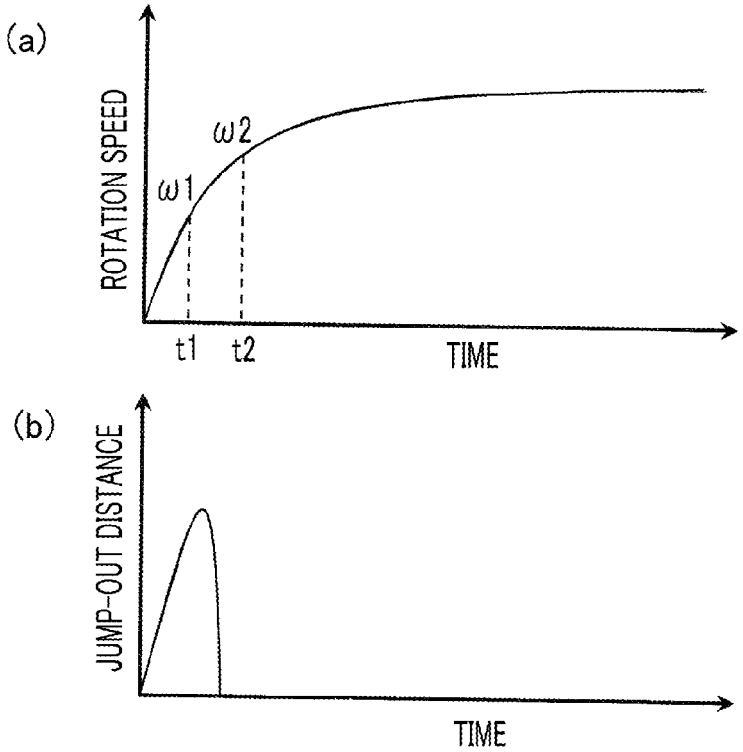
FIG. 12 is graphs for explaining estimation of jump-out distance of the moving bodies in the present invention.

FIG. 12(*a*) shows the relation between motor rotation speed and time elapsed in the engine startup device 1. Using the graph in FIG. 12(*a*), the angular acceleration β can be obtained from the following equation (1).

$$\beta=(\omega 2-\omega 1)/(t2-t1) \tag{1}$$

If thrust-out force of the moving body 3 in the axial direction is F1, friction force to the thrust-out force F1, Fμ and the lead angle of the notch 37*b*, θb, the thrust-out force F1 is given by the following equation (2).

$$F1=I\cdot\beta/r\cdot\tan(90°\theta b)-F\mu \tag{2}$$

Moreover, if force suppressing the jump out of the moving body 3 by the plunger spring 39 via the thrust-out mechanism 33 is F2 and a distance of the moving body jumping out in the axial direction between time t1 and t2 is Δ, the distance Δ is given by the following equation (3).

$$\Delta=(F1-F2)/m\cdot t^2 \tag{3}$$

The jump-out distance can be obtained as the total distance from time t0 when the motor starts rotating to time tn; therefore, the jump-out distance of the moving body 3 can be obtained by the following equation (4), which becomes as the graph shown in FIG. 12(*b*).

$$\text{Moving body jump-out distance} = \sum_{t0}^{t\Omega} \Delta l \tag{4}$$

The lead angle θb of the notch 37*b* of the output shaft 5 is decided in a manner as described above, whereby the moving body can be prevented from jumping out at startup of the motor rotation.

Most of existing engine startup devices are designed in such away that when the devices stopping, the helical spline 38 of the moving body 3 overlaps (engages with) the helical spline 37 of the output shaft 5 over the whole axial length of the helical spline 38. In contrast to the helical splines of the existing output shaft 5 and the moving body 3 as above, the engine startup device according to Embodiment 1 of the present invention is designed in such a way that part of the helical spline 38 of the moving body 3 overlaps as shown in FIG. 4 the helical spline 37 of the output shaft 5 when the engine startup device 1 stopping.

Moreover, the helical spline 37 of the output shaft 5 overlaps the helical spline 38 of the moving body 3 over the notch 37*b* of the output shaft 5. The reason why is that the longer the axial length of the notch 37*b* of the output shaft 5 is, the thinner the tooth becomes towards the end of the helical spline 37 of the output shaft 5, thereby reducing its strength. Therefore, the length along which the notch 37*b* of the output shaft 5 overlaps the helical spline 38 of the moving body 3 is decreased, whereby the axial length of the notch 37*b* of the output shaft can be decreased. Furthermore, the overlapping axial length is made exactly the length along which the notch and the helical spline certainly overlap each other, taking into consideration tolerance of relating dimensions and variations in assembly. Additionally, torque applied to the notch 37*b* of the output shaft 5 is very low, attributed to the inertia of the moving body 3 and rotation of the motor 2. When very high torque is applied thereto in its transmission from the motor 2 to the engine with the moving body engaging with ring gear 36, the transmission is performed through the power-transmitting-side tooth surface 37*a* of the output shaft 5, which is not changed from the original profile; therefore, reduction in strength of the notch 37*b* of the output shaft 5 does not cause any serious problem.

Figure 7:
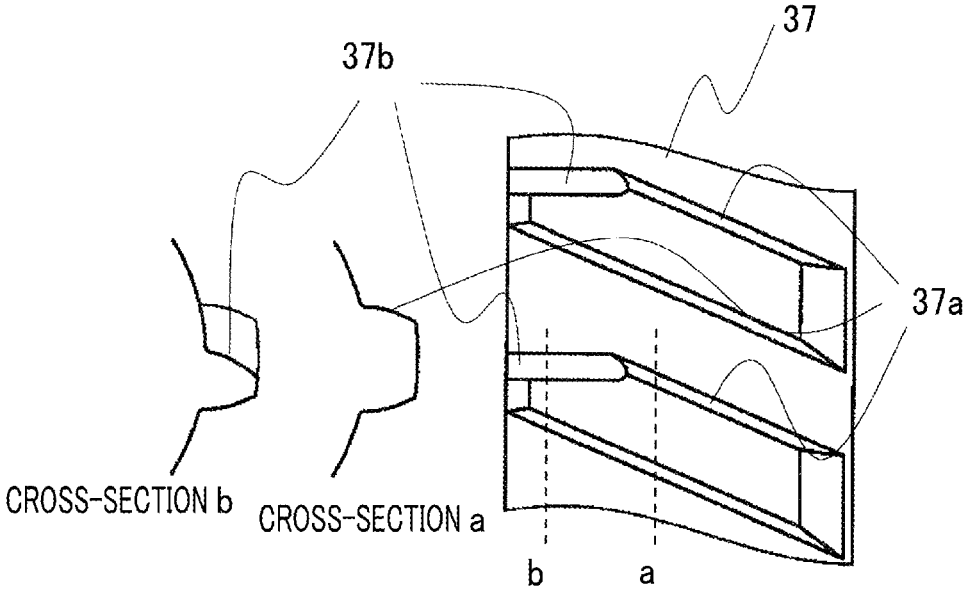
FIG. 7 is a detailed gear diagram showing the notches of the output shaft and the power-transmitting-side tooth surfaces thereof in Embodiment 1 of the present invention.

When the torque-transmitting-side tooth surface of the helical spline 38 of the moving body 3 is formed in an involute curve as shown in FIG. 7, if the power-transmitting-side tooth surface of the notch 37*b* of the output shaft 5 is also formed in the involute curve, the helical spline of the output shaft can face-contact the helical spline 38 of the moving body 3, so that pressure per unit area when torque is applied thereto can be reduced.

Furthermore, when the notch 37*b* of the output shaft 5 is a surface parallel with reference to the transverse gear tooth tip center of the helical spline, the notch 37*b* crosses the involute curve of the power-transmitting-side tooth surface 37*a* of the output shaft 5; therefore, the axial length of the notch 37*b* of the output shaft 5 becomes shorter toward the tip of the tooth from the root thereof. The axial length of the notch 37*b* of the output shaft 5 and the location of the helical spline 38 of the moving body 3 overlapping the notch must be set in accordance with the length of the shortened tooth tip side; however, by forming the notch 37*b* of the output shaft 5 in the involute curve, the axial length of the notch 37*b* of the output shaft 5 can be made the same at both the root of the tooth and the tip thereof, so that the axial length of the notch 37*b* of the output shaft 5 can be set short. In addition, even if the notch 37*b* of the output shaft 5 is not formed in the involute curve, the same effect can be produced by setting the notch at an angle equivalent to the transverse pressure angle, with reference to the transverse gear tooth tip center of the helical spline 37 of the output shaft 5.

Embodiment 2

Figure 8:
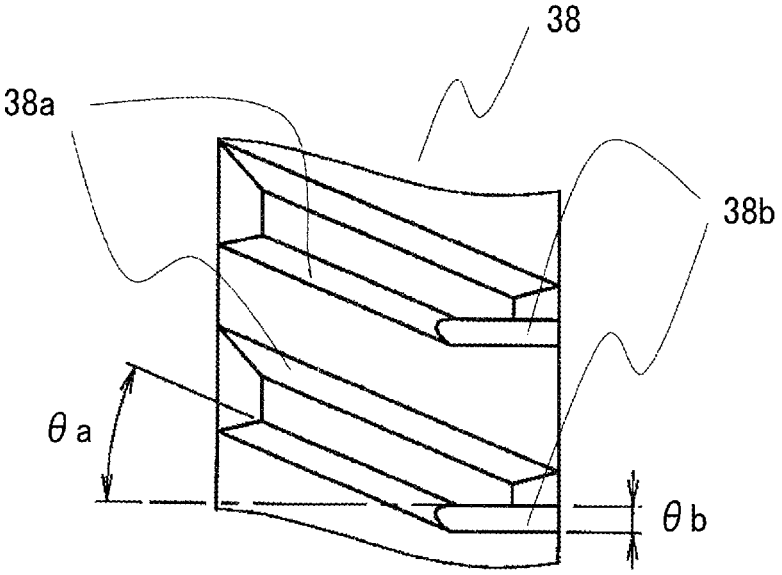
FIG. 8 is a detailed diagram showing the lead angles of notches of a moving body and power-transmitting-side tooth surfaces thereof in Embodiment 2 of the present invention.

The notch 37*b* is provided on the output shaft 5 in Embodiment 1; however in Embodiment 2, a notch 38*b* is provided as shown in FIG. 4(*b*) on the helical spline 38 of the moving body 3 instead, and as shown in FIG. 8, the lead angle θb of the notch 38*b* of the moving body is set, with respect to the motor shaft direction, smaller than the lead angle θa of the power-transmitting-side tooth surface 38*a* of the moving body (θa>θb).

Moreover, part (rear end) of the helical spline 37 of the output shaft 5 is designed to overlap the notch 38*b* of the moving body 3 when the engine startup device 1 stopping, whereby the same effect as that in Embodiment 1 can be produced.

Figure 9:
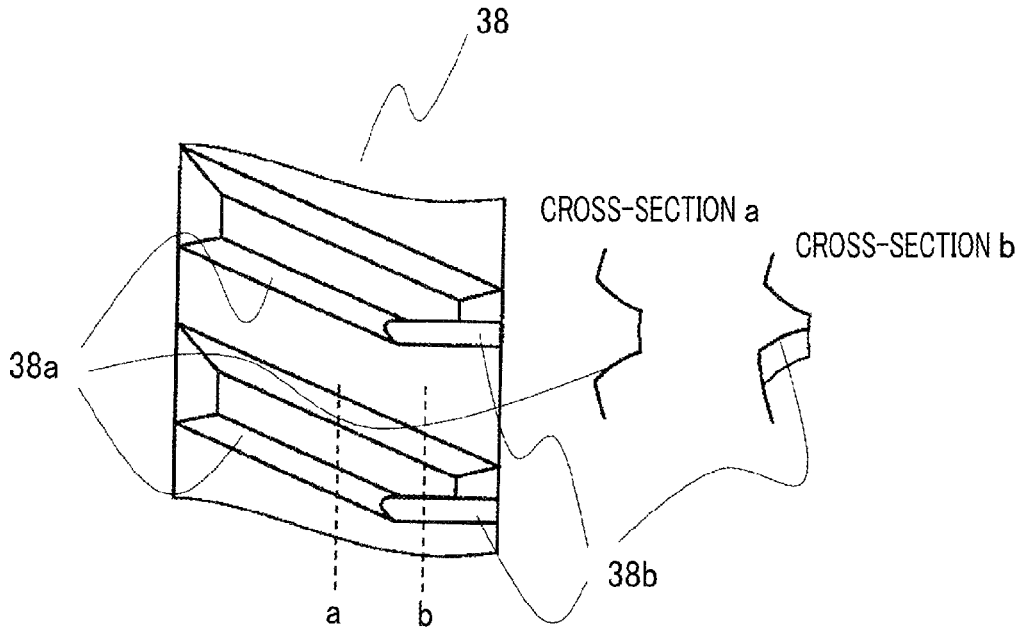
FIG. 9 is a detailed gear diagram showing the notches of the output shaft and the power-transmitting-side tooth surfaces thereof in Embodiment 2 of the present invention.

Furthermore, when the torque-transmitting-side tooth surface of the helical spline 37 of the output shaft 5 is formed in the involute curve as shown in FIG. 9, the torque-transmitting-side tooth surface of the notch 38*b* of the moving body 3 is also formed in the involute curve, whereby the tooth surface can face-contact the helical spline 37 of the output shaft 5, pressure per unit area when torque is applied can be decreased, and the axial length of the surface of the notch 38*b* of the moving body 3 can be made the same at both the root of the tooth and the tip thereof, so that the axial length of the notch 38*b* of the moving body 3 can be set short.

Additionally, even if the notch 38*b* of the output shaft 3 is not formed in the involute curve, the same effect can be produced by setting the notch at an angle equivalent to the transverse pressure angle with reference to the transverse gear tooth bottom center of the helical spline 38 of the output shaft 3.

Furthermore, the notch may be provided on both of the helical spline 37 of the output shaft 5 and the helical spline 38 of the moving body 3.

Embodiment 3

Figure 10:
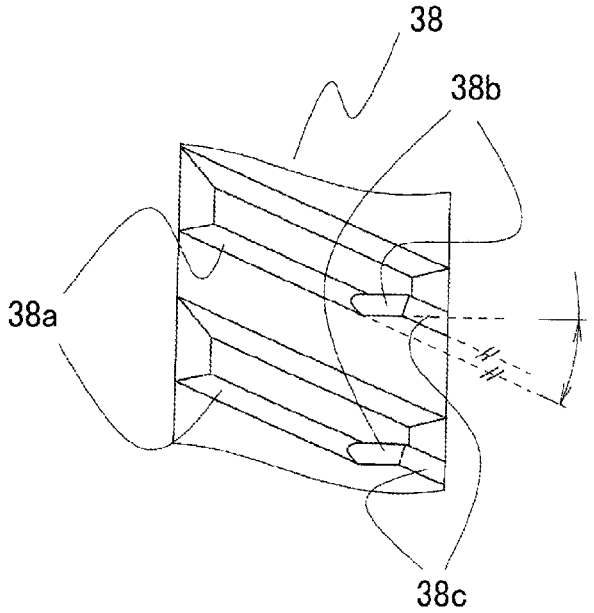
FIG. 10 is a detailed diagram showing notches of a moving body, power-transmitting-side tooth surfaces thereof and the lead angle of a tooth surface parallel to the power-transmitting-side tooth surfaces in Embodiment 3 of the present invention.

It is explained in Embodiment 1 that the longer the axial length of the notch is, the thinner the tooth of the helical spline becomes, and as a result the strength thereof will be lowered. The tip of the tooth becomes sharp in specifications requiring a large notch, so the tooth tip is likely to chip off. Therefore in this Embodiment 3, the notch 38*b* of the moving body 3 is not formed up to the tip of the helical spline 38, but limited within an axial length that is necessary for the notch engaging with the power-transmitting-side tooth surface at the rear end of the helical spline 37 of the output shaft, and the tip portion is formed in such a profile that a tooth surface 38*c* parallel to the power-transmitting-side tooth surface 38*a* is extended up to the notch 38*b* as shown in FIG. 10 and FIG. 11.

Figure 11:
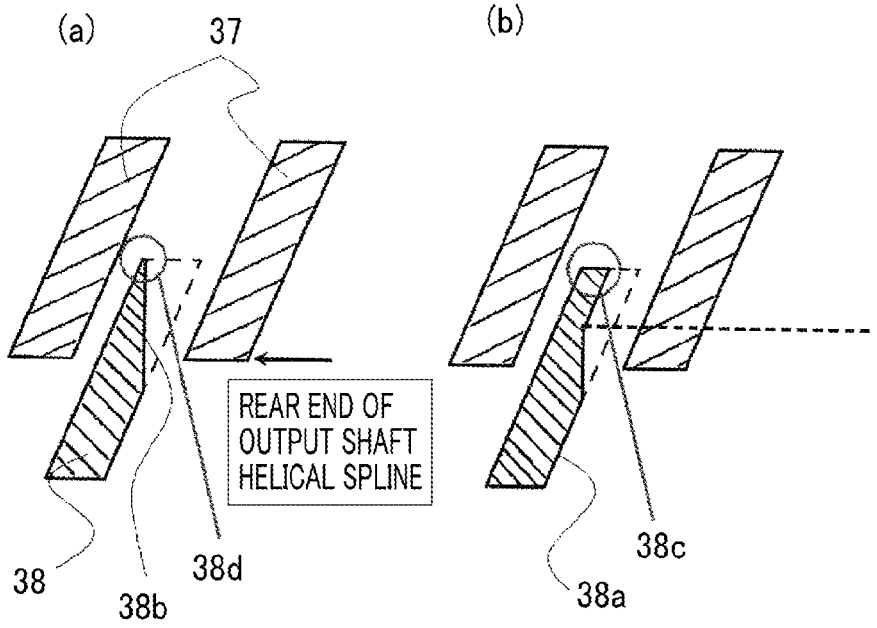
FIG. 11 is a diagram showing arrangement of helical splines of an output shaft and the moving body in Embodiment 3 of the present invention.

That is to say, the longer the notch 38*b* of the moving body becomes, the more the tip sharpens as 38*d* shown in FIG. 11(*a*). Embodiment 3 provides a solution to that, in which as shown in FIG. 11(*b*), the notch 38*b* of the moving body is formed up to a point from which the notch axially overlaps the rear end of the helical spline 37 of the output shaft, even if any tolerance is taken into consideration. Then, the lead angle of the tooth surface 38*c* is set so that the tooth surface 38*c* becomes parallel to the power-transmitting-side tooth surface 38*a* in the engine side beyond this point. By doing in this way, the tip of the notch 38*b* can be prevented from sharpening.

Additionally, the output shaft may be provided with a notch with the same profile as the power-transmitting-side tooth surface of the moving body.

INDUSTRIAL APPLICABILITY

The present invention is preferable for an engine startup device that transmits motor torque to a ring gear of the engine from a moving body, such as a pinion, so as to start up the engine.

DESCRIPTION OF THE REFERENCE NUMERALS

1: engine startup device
2: motor
3: moving body
5: output shaft
7: stopper
24: motor-operating core switch
26: motor-operating solenoid coil
27: motor-operating plunger
28: moving-body-operating core switch
29: moving-body-operating solenoid coil
32: moving-body-operating plunger
33: thrust-out mechanism
34: hook
35: electromagnetic switch
36: ring gear
37: helical spline of output shaft
37*a*: power-transmitting-side tooth surface of output shaft
37*b*: notch of output shaft
38: helical spline of moving body
38*a*: power-transmitting-side tooth surface of moving body
38*b*: notch of moving body
38*c*: tooth surface parallel to power-transmitting-side tooth surface of moving body
39: plunger spring

The invention claimed is:

1. An engine startup device, comprising:

a motor that produces torque with electric power supplied thereto;

an output shaft on which is formed a first helical spline that transmits the torque from the motor;

a moving body that has a second helical spline engaging with the output shaft and transmits the torque from the motor to an engine side; and an electromagnetic switch equipped with a mechanism that independently performs a function of magnetizing a motor-operating plunger by activating a motor-operating solenoid coil and switching on/off the power to the motor by the movement of the motor-operating plunger, and a function of magnetizing a moving-body-operating plunger by activating a moving-body-operating solenoid coil and thrusting out the moving body towards a ring gear side via a thrust-out mechanism by the movement of the moving-body-operating plunger; wherein a notch is formed on a power-transmitting-side tooth surface of at least one from among the first helical spline and the second helical spline of the output shaft and the moving body, and the helical splines of the output shaft and the moving body are arranged in such a way that the notch of the either one of the output shaft and the moving body engages with part of the helical spline of the other when the engine startup device stopping.

2. An engine startup device according to claim 1, wherein an angle formed by the notch with respect to a motor shaft direction is smaller than the lead angle of the helical splines.

3. An engine startup device according to claim 2, wherein the notch overlaps in the motor shaft direction the rear end of the first helical spline of the output shaft or the front end of the second helical spline of the moving body.

4. An engine startup device according to claim 3, wherein a surface of the notch is parallel to the power-transmitting-side tooth surface or is formed in an involute curve.

5. An engine startup device according to claim 4, wherein an angle formed by the surface of the notch is larger than a transverse pressure angle of the helical splines with reference to the transverse gear center of the helical splines.

* * * * *